United States Patent [19]

Cox

[11] Patent Number: 4,850,914

[45] Date of Patent: Jul. 25, 1989

[54] SKIM BOARD

[76] Inventor: Cavan J. Cox, 311 69th Ave. N. #904, Myrtle Beach, S.C. 29677

[21] Appl. No.: 34,648

[22] Filed: Apr. 6, 1987

[51] Int. Cl.[4] ..... B63B 35/72

[52] U.S. Cl. ..... 441/65; 441/74; 441/135

[58] Field of Search ..... 441/65–74, 441/135; 114/66, 357

[56] References Cited

U.S. PATENT DOCUMENTS

| | | | |
|---|---|---|---|
| 3,000,022 | 9/1961 | Cathey et al. | 441/65 |
| 3,042,945 | 7/1962 | Saeman | 441/135 |
| 3,050,751 | 8/1962 | Moon | 441/74 |
| 3,081,726 | 3/1963 | Betts et al. | 441/135 |
| 3,176,999 | 4/1965 | Atcherley | 441/74 |
| 3,808,621 | 5/1974 | French | 441/135 |
| 3,931,777 | 1/1976 | Colgan | 441/65 |
| 4,538,540 | 9/1985 | Cashmere | 441/74 |
| 4,691,658 | 9/1987 | New et al. | 441/135 |

FOREIGN PATENT DOCUMENTS

| | | | |
|---|---|---|---|
| 1169837 | 1/1959 | France | 441/135 |

*Primary Examiner*—Sherman D. Basinger
*Assistant Examiner*—Stephen P. Avila
*Attorney, Agent, or Firm*—Bailey & Hardaway

[57] ABSTRACT

A skim board for use in the shallow water at the edge is illustrated as having a body constructed of a clear, transparent plastic sheet having a concave surface at the top for the feet of the user and a convex surface at the bottom. A pattern in bright color extends across the clear plastic sheet making same visible in the shallow water while a clear plastic area remains through which the user may see the water line and thus know where to place his feet when jumping on the skim board.

4 Claims, 1 Drawing Sheet

SKIM BOARD

BACKGROUND OF THE INVENTION

Skim boards have long been in use on the beach in the shallow water covering the sand at the edge of the surf. Generally such skim boards are elongated as illustrated in U.S. Pat. No. Des. 263,860. Other prior art includes U.S. Pat. Nos. 3,050,751, 3,176,999, 3,931,777, 4,538,540 and Des. 195,384. Such skim boards have generally been made from wood or plastic foam and the like so as to float on the water. Generally these structures have not been such that the water line between the skim board and the sand was capable of being observed by the user.

Accordingly, it is an important object of the present invention to provide a skim board which is sufficiently heavy and rugged to operate effectively in the shallow water.

It is another important object of the invention to provide a skim board having a generally transparent body constructed of sufficiently heavy material to glide on the shallow water and yet be readily visible to the user.

Another important object of the invention is the provision of a colored pattern across a clear plastic sheet forming a body of the skim board such as to increase the visibility of the skim board when it glides on the shallow water and provide an area of clear plastic wherein the water line is observable to the user.

SUMMARY OF THE INVENTION

It has been found that a skim board may be provided for use on the beach on wet sand and in shallow water at the edge of the shore line wherein a body constructed of clear plastic of sufficient density to glide on the shallow water is provided with a concave upper surface and a convex lower surface wherein a colored pattern extends across the body portion of the skim board and an area of clear plastic is provided so that the user may see the water line through the skim board. Preferably the clear plastic is plexiglas and the like, and a lower beveled edge is provided on generally circular segments forming respective ends of the skim board with sides spaced only slightly less than the diameter of the circle or circles generating the segments at the ends.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

The drawings illustrate a skim board for use on the beach in shallow water covering the sand at the shore line including a clear, transparent plastic sheet of sufficiently high density to glide on the shallow water forming a body of the skim board. A concave upper surface A is formed in said clear plastic sheet as well as a convex lower surface B in the clear plastic sheet. A colored pattern C extends across the clear plastic sheet making the clear plastic sheet readily visible in the shallow water. An area of clear plastic is defined by the colored pattern making a water line formed between the shallow water and the convex lower surface visible to the user through the skim board. Preferably the plastic is plexiglas, and a lower beveled edge D borders the convex lower surface. Opposed generally circular segments E form respective ends of the clear plastic sheet, and opposed sides tapering inwardly at each end are spaced apart slightly less than the diameter of the circle generating the segments.

The concave upper surface A is formed in the clear plastic sheet preferably by utilizing a plastic sheet formed into the proper shape which has a thickness sufficient to afford substantial rigidity to the skim board body during use. The concave surface A may be placed into the clear plastic as by exerting a force upon the sheet so as to cause the body to be depressed in the center which results in the placement of the convex or generally disked out lower surface in the plastic sheet to facilitate skimming over the wet sand as well as the concave upper surface to accommodate the user when standing or otherwise skimming on the board.

Figure 1:
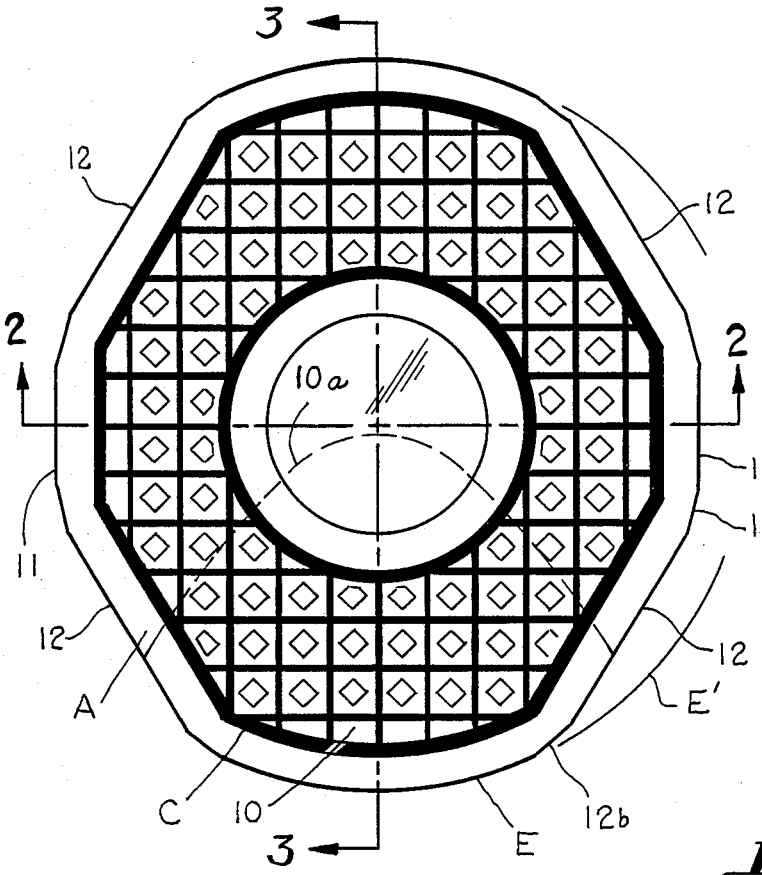
FIG. 1 is a top plan view illustrating a skim board of generally circular configuration with colored pattern and an area of clear plastic constructed in accordance with the invention.

As best observed in FIG. 1, an opaque colored pattern C is provided extending across the clear plastic sheet. It will be observed in FIG. 1 that an area of clear plastic 10 is provided in the body of the skim board and that the water line 10a may be observed therethrough. Rather than utilizing a contrasting pattern of opaque or transparent colored portions, the entire body or a portion of the pattern on the board may be covered with a transparent colored portion.

A lower beveled edge D is provided in a border portion on the lower side of the skim board. Segments E are formed at respective opposed ends of the skim board, and sides 11 are spaced only slightly less than the diameter of the circle generated at end segments E. Generally inwardly tapering side portions 12 are provided at each of the spaced sides 11 which extend and intersect with the end segments creating a generally circular shape to the skim board. As illustrated at E′ in FIG. 1, the segments if continued may form a true circle and as further illustrated, the sides are only slightly narrowed from the true circle. A plastic sheet of ¼ inch thickness with a length of 30 inches at its longest point and 26 inches at its widest point has been found to be satisfactory.

Figure 3:
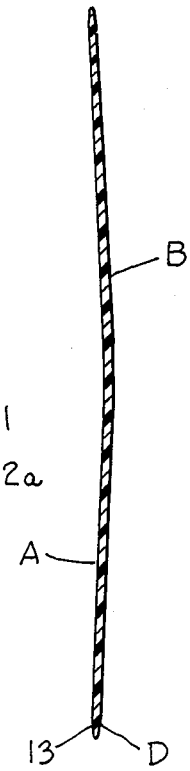
FIG. 3 is a transverse sectional elevation taken on the line 3—3 in FIG. 1.
Figure 2:
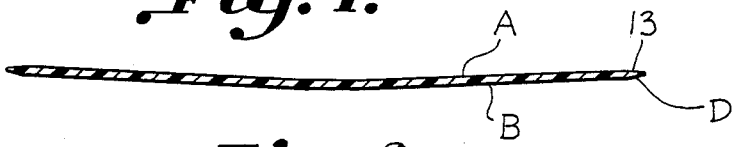
FIG. 2 is a longitudinal sectional elevation taken on the line 2—2 in FIG. 1.
Figure 4:
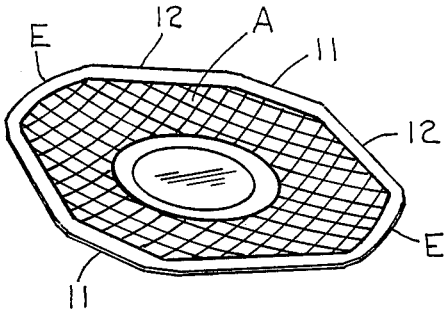
FIG. 4 is a perspective view of the skim board illustrated in FIG. 1.

If desired, the arcs generating the segments may have spaced centers or only one end or both ends may be arcuate. A slight break is illustrated at 12*a* and another at 12*b* to carry out the tapering configuration of the sides. As will be observed in FIGS. 2 and 3, the upper concave portion A has a slight bevel as at 13 bordering the body of the skim board.

While a preferred embodiment of the invention has been described using specific terms, such description is for illustrative purposes only, and it is to be understood that changes and variations may be made without departing from the spirit or scope of the following claims.

What is claimed is:

1. A skim board for use on the beach in shallow water covering the wet sand at the shore line comprising:

a clear, transparent plastic sheet of sufficiently high density to glide on the shallow water;

a concave upper surface in said clear plastic sheet;

an area of clear plastic in said clear, transparent plastic sheet making a water line formed between the shallow water and a convex lower surface visible to the user through the skim board ; and a colored pattern across said clear plastic sheet contrasting with said water and sand whereby the clear plastic sheet is visible in shallow water while said clear plastic area remains through which the user may see the water line and thus know where to place his feet when jumping on the skim board.

2. The structure set forth in claim 1 wherein said plastic is plexiglas, and including a lower beveled edge bordering said convex lower surface.

3. The structure set forth in claim 2 including opposed generally circular segments forming respective ends of said clear plastic sheet, and opposed sides tapering inwardly at each end spaced slightly less than the diameter of the circle generating said segments.

4. A skim board for use on the beach in shallow water covering the wet sand at the shore line comprising:

a transparent plastic sheet of sufficiently high density to glide on the shallow water and provide substantial rigidity;

a concave upper surface in said plastic sheet;

a convex lower surface in said plastic sheet;

an area of transparent plastic in said clear, transparent plastic sheet making visible a water line between the shallow water and said convex lower surface visible to the user through the skim board ; and a colored portion contrasting with said water and sand extending across said plastic sheet whereby the clear plastic sheet is visible in shallow water while said clear plastic area remains through which the user may see the water line and thus know where to place his feet when jumping on the skim board.

* * * * *